US006817043B2

(12) United States Patent
Zars

(10) Patent No.: US 6,817,043 B2
(45) Date of Patent: Nov. 16, 2004

(54) SAFETY SWIMMING POOL REPLACEMENT DRAIN COVER APPARATUS AND METHOD

(76) Inventor: Leif Alexander Zars, 438 Sandau Rd., San Antonio, TX (US) 78216

( * ) Notice: Subject to any disclaimer, the term of this patent is extended or adjusted under 35 U.S.C. 154(b) by 0 days.

(21) Appl. No.: 10/295,073

(22) Filed: Nov. 15, 2002

(65) Prior Publication Data

US 2004/0093666 A1 May 20, 2004

(51) Int. Cl.[7] ..... E04H 4/12
(52) U.S. Cl. ..... 4/504; 4/292; 4/507
(58) Field of Search ..... 4/288, 292, 504, 4/507, 509

(56) References Cited

U.S. PATENT DOCUMENTS

| | | | | | |
|---|---|---|---|---|---|
| 2,749,999 | A | * | 6/1956 | Schmid | 4/288 X |
| 3,378,858 | A | * | 4/1968 | Jacuzzi | 4/507 X |
| 3,940,807 | A | | 3/1976 | Baker et al. | |
| 4,170,047 | A | * | 10/1979 | Corsette et al. | 4/262 X |
| 4,658,449 | A | * | 4/1987 | Martin | 4/504 X |
| 5,690,476 | A | | 11/1997 | Miller | |
| 5,734,999 | A | | 4/1998 | Nicholas | |
| 5,809,587 | A | | 9/1998 | Fleischer | |
| 5,822,807 | A | | 10/1998 | Gallagher et al. | |
| 5,894,609 | A | | 4/1999 | Barnett | |
| 5,978,981 | A | | 11/1999 | Nelson | |
| 6,003,165 | A | | 12/1999 | Loyd | |
| 6,009,573 | A | | 1/2000 | Thibault | |
| 6,038,712 | A | | 3/2000 | Chalberg et al. | |
| 6,088,842 | A | | 7/2000 | Barnett | |
| 6,170,095 | B1 | | 1/2001 | Zars | |
| 6,230,337 | B1 | | 5/2001 | Barnett | |
| 6,269,493 | B2 | | 8/2001 | Sorensen | |
| 6,295,661 | B1 | | 10/2001 | Bromley | |
| 6,330,724 | B1 | * | 12/2001 | Belle | 4/288 |
| 6,341,387 | B1 | | 1/2002 | Zars | |
| 6,360,379 | B1 | | 3/2002 | Lane et al. | |
| 6,393,631 | B2 | | 5/2002 | Schroader | |
| 6,397,408 | B1 | | 6/2002 | Veloskey et al. | |
| 6,408,452 | B1 | | 6/2002 | Bromley | |
| 2001/0042267 | A1 | | 11/2001 | Wilson et al. | |
| 2002/0078496 | A1 | | 6/2002 | Mullings | |

* cited by examiner

*Primary Examiner*—Robert M. Fetsuga
(74) *Attorney, Agent, or Firm*—Charles W. Hanor, P.C.

(57) ABSTRACT

A replacement drain cover apparatus for a swimming pool drain to protect a swimmer from entrapment of the swimmer's body or hair and having a drain sump adapter ring for securing means into a pool drain sump and an installation plate for releasably securing onto the adapter ring and for positioning the adapter ring in a pool drain sump for securing the adapter ring in the correct position in the pool drain sump for a drain cover. An anti-entrapment drain cover having a size substantially greater than the pool drain sump is secured to the adapter ring to cover the drain sump and has sufficient cross sectional area so that the velocity of flow under and though the drain cover at any point on the drain cover even if partially blocked by a swimmer is at a rate to protect a swimmer from entrapment of the swimmer's body and hair.

23 Claims, 7 Drawing Sheets

SAFETY SWIMMING POOL REPLACEMENT DRAIN COVER APPARATUS AND METHOD

CROSS-REFERENCE TO RELATED APPLICATIONS

NA

STATEMENTS REGARDING FEDERALLY SPONSORED RESEARCH OR DEVELOPMENT

NA

REFERENCE TO A MICROFICHE APPENDIX

NA

BACKGROUND OF THE INVENTION

1. Field of the Invention

The present invention relates to a drainage cover system for a drain located on the drain of a swimming pool or spa. More particularly, the invention relates to a method and apparatus for preventing the entrapment of a person by the drain of a swimming pool or spa and related injury. More particularly, the invention relates to a method and apparatus for installing a safety swimming pool drain cover in an existing swimming pool. Additionally, the invention relates to a method and apparatus for installing a safety swimming pool drain cover in new construction of a swimming pool.

Swimming pools and spas typically use a pump to drain and recirculate water and supply the filter or supply heated water when a heater is used. Such systems usually have a single main drain or sump located at or near the bottom or lowest part of the swimming pool or spa. In the case of inlets for spas the sump may be in the side of the pool or spa. A portion of the water is normally pumped or suctioned out of the swimming pool or spa through the main drain, into an inlet of a suction pump, and then drained or filtered along with any water from a skimmer and recirculated back into the swimming pool or spa through jets located around the interior walls of the swimming pool or spa.

The drain used in a swimming pools or spa create suction caused by the large volume of water passing through the drain, wherein the suction can be strong enough to trap bathers on the drain. When bathers place their heads or bodies in the vicinity of an active drain, their hair or a portion of their body may become entrapped by the drain, such as at a cover or grating. A blocked drain can develop a strong vacuum within a few tenths of a second. If the suction pressure is strong enough, a bather who is entrapped by a drain may not be able to break free of the suction and may ultimately drown.

Each year, hundreds of young children die and thousands come close to death due to entrapment at a drain in swimming pools and spas. Safety organizations, such as the United States Consumer Product Safety Commission (CPSC), the National Spa and Pool Institute (NPSI), and various state government entities, have acknowledged the need for devices that protect against swimming pool or spa drain entrapment. The CPSC estimates that each year about 300 children under 5 years of age drown in residential swimming pools, and that hospital emergency room treatment is required for approximately another 2,300 children under 5 years of age who were submerged in residential swimming pools. In fact, drowning is recognized as a leading cause of death of children under the age of 5 years in California, Arizona, and Florida. Of particular concern are entrapments involving hair entanglement, limb entrapment, body entrapment, and disembowelment by a drain. Hair entanglement/entrapment occurs when a bather dips below a water surface and his or her hair is sucked into and becomes entangled on a drain grate in the main drain of a swimming pool or spa. Body entrapment typically occurs when part of a bather's torso completely covers an unprotected or damaged drain, thereby creating a vacuum within the drain from which the bather cannot break free. Limb entrapment refers to accidents in which a bather's arm or leg is sucked into a main drain of a swimming pool or spa. Disembowelment accidents occur where small children, usually two to six years old, place their buttocks over a drain, covering the drain creating a seal. Injury occurs when the greatly increased suction acts to eviscerate the child when their lower intestines are sucked out of their body through their anus.

Various devices have been used to prevent entrapment, for example, conventional drain systems have used "anti-vortex" or "anti-entrapment" covers, which lack holes at the top, preventing or discouraging a person from covering that hole, and which reduce flow rates (to perhaps less than 6 ft./sec.) to reduce turbulence. Other conventional drain systems for swimming pools and spas have used multiple drains, as opposed to just a single drain, separated by sufficient distance, to prevent a vacuum from being formed when one of the drains is obstructed. Further ways include gravity-fed collector sumps, and vent stacks, which attempt to limit total suction to about 2 ft.-$H_2O$.

A system with multiple drains has its drawbacks, however in that it can be significantly more complex and expensive, especially in retrofit. Additionally, multiple bathers can cover the multiple drains, permitting the creation of the hazardous vacuum, which the system is designed to prevent. Another disadvantage is that the grates or other covers may fail, permitting a person to cover that drain, and become entrapped, or disemboweled. Another is that even grates designed to be "anti-vortex" or "anti-entrapment" may still permit hair entanglement in the drain cover support attachment points or in the cover openings themselves. Yet another disadvantage is that not all swimming pools or spas use the same diameter main drain preventing the use of a single grate or cover in all swimming pools or spas. Further, it is not clear that multiple drains per pump provide sufficient protection because of the potential for dynamic hydraulic imbalance due to debris build up in one of the drains, which may permit a large increase in suction at the other drain.

Pressure detection systems have also been used to reduce the risk of entrapment. Pressure detection systems shut off a drain system when the vacuum pressure within the system reaches a critical level, thus relieving the vacuum at the main drain after a certain time lapse. Unfortunately, the complexity and time delay of such systems raises reliability concerns. Thus, a need still exists for an improved method and apparatus for preventing entrapment.

Newer pools may have a relatively large surface area for the drain cover so that a swimmer can not block enough of flow to be entrapped. These newer drain sumps may be one and one half feet square or two feet in diameter. However, there are many thousands of existing pools and spas that have drain sumps with openings and drain covers less than twelve inches in diameter.

The present invention is primarily directed to retrofitting the thousands of existing pools and spas that do not meet the newer codes and guidelines to prevent swimmer entrapment at the pool or spa drain. It is possible to drain an existing pool and chisel out the concrete around the drain so that a much larger drain sump can be installed that will have a large intake area and large drain cover that can not be blocked by a swimmer. However, the cost of changing the drain sump in a pool and repairing the concrete around the drain sump is substantial.

A better way is needed to retrofit the thousands of existing pools or spas to place them in compliance with newer standards for drain covering sizes that prevent entrapment of a swimmer and drowning. An object of the present invention is to easily and quickly accomplish the retrofitting at a small cost.

2. Description of the Related Art

U.S. Pat. No. 6,360,379 discloses a domed cover for a swimming pool drain that is lockable by a bridge that has upper arms extending downward and lower arms extending upward which are drawn in their respective directions by a bolt that passes through threaded upper and lower hubs. The bridge has bearing feet pivotally connected between the adjacent facing ends of the arms that, once extended, exert pressure against the inside surface of the drain. The bolt passes through the center of the domed cover with an exposed bolt cap to allow for rotating the bolt, extending the arms and locking the cover in place.

U.S. Pat. No. 6,088,842 discloses a drain structure for a pool or hot tub that has normally present suction or drain forces. The drain has a plurality of interior grating members, which are cantilevered from the inner wall and tapered lower releases surfaces, designed to alleviate or eliminate hair entanglement or vacuum problems with the body. The drain surfaces facilitate the release of hair strands that may become entangled or knotted due to the vacuum of the drain. In another embodiment the interior gratings may have sharp cutting edges designed to sever or snap the entangled or knotted hair strands.

U.S. Pat. No. 5,978,981 discloses a device to for hair control that includes a grate with a plurality of elongated flow channels isolated from each other, and is installed into the pump inlet of pools and spas. The channels are designed to decrease turbulence and prevent hair from entangling or knotting behind the grate in such a manner that a person's head would be held under water. The channels of the grate are at least 18 inches long and can be linear or in a helical pattern.

U.S. Pat. No. 6,009,573 discloses a safety diffuser that is used with the suction inlet of a pool or spa, consisting of a tubular portion that is sealed to the suction inlet and has strategically placed holes designed to prevent the user of the pool or spa from being able to block all of the holes and be drawn to the device and held underwater, thereby reducing the danger of drowning.

U.S. Pat. No. 6,393,631 discloses a pool drain safety cover system and method. The system consists of a base with at least one primary fluid aperture and a plurality of secondary apertures. The cover also includes a grate that extends across, at a minimum, the primary fluid aperture, to allow the drain water to pass through it. The grating has at least an upper and a lower layer which are adjacent to each other and are each comprised of a plurality of spaced ribs to allow drain water to pass through. The invention also includes a method describing the same. The cover is described as being attached by any chemical or mechanical means including adhesives, screws or nails.

U.S. Pat. No. 6,397,408 discloses a ramped cap unit for installation over the main drain of a swimming pool. The cap unit is equipped with an upstanding anti-vortex safety drain cover, wherein the ramped cap unit is shaped in a manner to allow a pool cleaner to travel over and across it without interruption or disruption. The cap unit comprises a generally inverted saucer defining a ramped surface having a diametric size to fit over the safety drain cover. An array of ribs formed on the underside of the cap unit engage an outer periphery of the upstanding drain cover to retain the cap unit in position on the drain cover. A large plurality of holes are formed in the cap unit at spaced-apart locations to permit downward water flow therethrough substantially without disrupting the anti-vortex and safety functions of the drain cover it is in position over.

U.S. Pat. No. 6,340,035 discloses an anti-vacuum cover defined by a centrally supported grating together with at least one outwardly extending tributary tube through which fluid may pass if the grating is obstructed. The outboard end of the tributary tube may be shaped in any fashion so as to prevent one from being able to block it with ones hand. The grating may further incorporate cantilevered elements so as to prevent hair entanglement by allowing any entangled or knotted hair to simply slide over the element and out of the drain. The tributary tubes are described as being at least 18 inches long and either straight or curved to minimize hair entanglements and have the ends far enough away from the grate so that it prevent one from being able to block all openings to the drain with ones body. The tributary tubes may also direct the flow of fluid so as to be opposite of the flow of the vortex and aid in the counter effects of a vacuum. The invention is disclosed as being held in position by screws.

U.S. Pat. No. 5,734,999 discloses a floor drain grate that including two to three separate regions through which water can flow into the drain. The regions are spaced-apart, preferably one to two feet, to effectively prevent a swimmer from covering all openings simultaneously, preventing suction entrapment. One or more elongated channel portions are used to create a flow passage structure to space apart the inflow regions, and a central portion overlies the drain, and provides a further inflow region. The floor drain grate, including the channel portions, is disclosed as overlaying the pool floor. The central portion is disclosed as being integrally formed with the central portion, is as being attached thereto using screws or adhesives.

U.S. Pat. No. 3,940,807 discloses a outlet drain for a spa including channels extending radially substantially in all directions from the central drain aperture through which water can enter the drain. The channels extend approximately two feet, from the ends of opposing channels, to effectively prevent a swimmer from covering all of the channels simultaneously, preventing entrapment. It also discloses an anti vortex plate covering the drain sump. The drain is disclosed as being able to be integrally molded with or bonded to the bottom of the pool, or to replace the existing drain in a pool or spa. The vortex plate is disclosed as being held in position by screws, and the retrofittable drain is held in place by spring clips that apply a downward force to pride a secure fit and to prevent unintended removal.

U.S. Pat. No. 6,170,095 discloses a main drain safety grate apparatus that utilizes an elongate drain, frame and grate that distributes the suction flow of water over a large surface to avoid full blockage of the grate, and also utilizes a bendable or deformable, upwardly releasable grate that has a section slotted to permit water to drain therethrough. The grate is ordinarily restrained from upward movement by a slot in each end of the frame into which the ends of the grate fit, and from downward movement by two shelves on which the grate may be supported. The grate may be released from the frame by an upward farce applied at the section provided for drainage, which bends, or bows, the grate in an arcuate shape, and acts to shorten the length of the grate relative to the slots into which it is fitted. The bowing effect also serves to rotate a rounded surface and a corner of the end of the grate so as to reduce the effective length by rotating the corner away from the point of contact of the slot and the grate, and permitting that contact point to move over the rounded surface and effectively breaking away freeing anyone whose hair or other body part may have become entangled or entrapped. The apparatus is disclosed as being implemented during the construction of the pool.

U.S. Pat. No. 5,809,587 discloses a safety device for use in a suction outlet assembly of a swimming pool, whirlpool or spa or the like that consists of a cover mounted over the opening without substantially obstructing the flow of water and an obstructing mechanism for obstructing an opening in communication with the main drain pump of the swimming pool, whirlpool spa or the like if the cover is not properly positioned or affixed to the outlet assembly. If the cover does become dislodged or is no longer properly positioned, the obstructing mechanism, consisting of a plunger and a flapper valve which is pivotally mounted to the assembly, will move from opened to closed position, thereby blocking the flow of water and preventing the suction of a body or hair into the suction outlet.

U.S. Pat. No. 6,295,661 discloses an automatic shut off valve for installation in a swimming pool or spa main drain. The automatic shut off valve consists of a soft gasket, ball and ball spring between a grate and a housing. The grate is free to reciprocate up and down relative to the housing. Downward reciprocation of the grate urges the ball into sealable engagement with a valve seat in the housing. During operation, a swimmer covers sufficient grate apertures so that the grate is moved downwards as urged by the main drain suction. The downward motion of the grate urges the ball into sealable engagement with a valve seat in the housing where it is securely held by the main drain suction. In this fashion the ball is entrapped instead of the swimmer, thus avoiding harm to the swimmer. If the grate and ball should become dislodged a spring-loaded cap is pivotally attached to the housing and swings down urged by the main drain suction thereby effectively sealing off the drain and preventing any suction related injuries. The automatic shut off valve is disclosed as being held in place by screws.

U.S. Pat. No. 6,408,452 discloses an automatic shut off valve for installation in a swimming pool or spa main drain. The automatic shut off valve consists of a ball and ball spring between a diaphragm and a housing. The diaphragm is made of resilient material and is free to reciprocate up and down relative to the housing. Downward force on the diaphragm urges the ball into sealable engagement with a valve seat in the housing. During operation, a swimmer covers sufficient diaphragm apertures so that the diaphragm center is moved downwards as urged by the main drain suction. The downward motion of the diaphragm urges the ball into sealable engagement with a valve seat in the housing where it is securely held by the main drain suction. In this fashion the ball is entrapped instead of the swimmer, thus avoiding harm to the swimmer. A back-up shut off function is provided by a cap spring-loaded into a closed position whence it migrates shout the ball and diaphragm become dislodged. The automatic shut off valve is disclosed as being held in place by screws.

U.S. Pat. No. 6,038,712 discloses a suction assembly for use in whirlpool baths and the like that employs an air induction tube to induct air into the recirculating water pump to cease pumping operation when the face of the assembly is blocked. The induction tube is connected to a bleed path formed between the induction tube and a surrounding coaxial face tube extended into the assembly and empties the induction tube. Air is then pulled into the pump, causing the pump to lose prime thereby reducing pump pressure to zero and allowing the hair or other blocking material to be removed. In a preferred embodiment, the induction tube is connected to the air inlet of at least one venturi-type hydromassage jet assembly. The suction assembly employs a spring-loaded induction stem, which bears compressively against the interior face of the suction cover, thereby permitting use of conventional suction covers. The suction assembly discloses that the front face is attached to the assembly by screws.

U.S. Pat. No. 5,822,807 discloses a suction relief apparatus for relieving suction at a suction connection of a swimming pool or spa having a main valve member movable from an open to a closed position to relieve suction at the suction connection in the event of a blockage of the suction connection in the pool. The main valve remains closed until a reset valve is opened, at which time a spring returns the main valve to the open condition, enabling suction to resume at the suction connection of the pool.

U.S. Pat. No. 6,341,387 discloses a vacuum elimination device that entails a "T"-type connection installed on the suction line from between the recirculating pump system and the main drain of a swimming pool. Involved is an interior vertical pipe fluidly connected to the main drain suction line via the "T"-type connection opening downward which is enclosed within an exterior vertical pipe of larger diameter that is closed at the bottom and vented to the atmosphere at the top. The configuration of vertical pipes creates a column of water that is vented to the atmosphere during normal operation, but when the main drain is blocked the recirculating pump evacuates the column of water finally drawing only air from the vented opening causing the recirculating pump to lose prime and release the blockage.

U.S. Pat. No. 6,269,493 discloses a break away drain cover for a spa employing a drain cover with a magnet attached to it and a magnetically actuable reed switch, so that once the drain cover breaks away or is removed it will cause the reed switch to change state which opens a circuit controlling the operation of the spa circulation system. As a result, the spa circulation system cannot operate without the drain cover attached, reducing the chance that a spa user might be harmed if the user's hair becomes entangled in the drain cover.

U.S. Pat. No. 5,894,609 discloses a system for periodically removing the suction source from each drain in a pool or tub so that one sitting on a drain can readily remove himself from the drain whenever desired. The system is designed to alternate the suction for the pool or tub drains by alternating the suction from one drain to another. The is accomplished by either mechanically rotating drain pipes or by electronically turning on or off the pumps via a timer.

U.S. Pat. No. 5,690,476 discloses an electrical circuit adapted to shut-off power to a water reservoir pump whenever the drain becomes blocked. The electrical circuit comprises a vacuum-operated switch that opens the circuit whenever a partial vacuum draw or a predetermined pressure is experienced.

U.S. Pat. No. 6,003,165 discloses an electrical circuit adapted to shut-off power to a water reservoir pump in a portable spa whenever the drain becomes blocked. The electrical circuit comprises a vacuum-operated switch that opens the circuit whenever a partial vacuum draw or a predetermined pressure is experienced on the drain of the portable spa.

BRIEF SUMMARY OF THE INVENTION

The present invention relates to a new and improved safety device, which overcomes the problems and disadvantages of the prior art discussed above. More particularly, the safety device is adapted for use in the main drain of an existing swimming pool, spa or the like. The safety device is designed to replace the standard small drain covers on drain sumps of existing pools or spas to make the drains safer and help avoid entrapment of a swimmer on the older pools.

In accordance with the invention an installation plate is provided for determining the proper placement of the drain cover or cover plate and adapter ring for a swimming pool or spa in a position covering the main drain with the purpose of effectuating a proper seating of the anti-entrapment drain cover. The installation plate is substantially the same diameter and size as the drain cover with the exception of an opening defined by a three lobed hole in the center. The opening allows for access to the stainless steel adapter ring bolts during installation. After installing the adapter ring the installation disk is removed and the drain cover is attached to the adapter ring. Once the drain cover is attached, a swimmer can not access them to loosen them so the adapter ring remains firmly in place.

In a preferred configuration, the drain cover has a disc shape having a diametric size and shape to rest on the swimming pool or spa floor and extend well beyond the opening of the main drain sump, for the purpose of providing a large enough surface area so as to prevent a bather from blocking the entire drain and creating a seal on the main drain by placing his or her body on it. A large plurality of spacer ribs or ribs formed on the underside of the drain cover extend radially from the center out to the edge of the drain cover. Each ridge is equidistance from neighboring ribs to allow for fluid movement under the disc once the ribs are resting on the pool bottom surface surrounding the main drain of the swimming pool or spa. The ribs vary in length alternating between longer and shorter ribs providing the greatest flow of water under the drain cover. A large plurality of small, circular holes or holes permeate the entire surface of the disc excluding a circular area, the diameter of which is greater than that of the main drain, immediately at the center of the drain cover to permit downward flow therethrough substantially without disrupting the safety function of the solid center portion of the drain cover. The drain cover utilizes a adapter ring with three equally spaced threaded stainless steel bolts that extend through the ring, from the center outward, for the purpose of extending to lock the ring in place within the main drain sump. The adapter ring acts as a universal mount for the drain cover, so as to fit any typical diameter drain sump. The adapter ring when installed in the drain allows fluid, once it has passed through and around the drain cover, to flow through its open center and around the outsides between the ring and the drain wall. The adapter ring may be installed at an angle to allow for the drain cover to lay flush on the pool bottom. The drain cover is finally securely joined with stainless steel tamper proof screws to the adapter ring so that the drain cover cannot be dislodged on accident or by mischief.

When the drain cover includes an installation opening in the center it can be used in lieu of an installation plate for installing the adapter ring in a drain sump. A small cover would be installed with the drain cover to cover the installation opening after the adapter ring is secured in place.

It is an object of the invention to provide a safety drain cover apparatus and method for an existing swimming pool drain to protect a swimmer from entrapment.

It is an object of the invention to provide a method for installing a safety drain cover in an existing swimming pool drain to protect a swimmer from entrapment.

It is an object of the invention to provide a drain sump adapter ring and drain cover that can be easily secured into an existing pool drain sump.

It is an object of the invention to provide a drain sump adapter ring and drain cover that can be easily secured into an existing pool drain sump without having to drain the pool.

It is an object of the invention to provide an installation plate and method for positioning a adapter ring in an existing pool drain sump.

It is an object of the invention to provide an anti-entrapment drain cover for an existing pool that has sufficient cross sectional area so that the velocity of flow though the drain cover at any point on the drain cover even if partially blocked by a swimmer and at any point on the drain cover when there is no blockage is at a rate to protect a swimmer from entrapment.

It is an object of the invention to provide an installation plate with the same diameter and size as the drain cover to position the adapter ring at the correct position in an existing pool sump.

It is an object of the invention to provide an installation plate with an access opening to allow access to adapter ring securing means to allow securing of the adapter ring at the correct position in an existing pool sump.

It is an object of the invention to provide an anti-entrapment drain cover for an existing pool with sufficient cross sectional area and flow rate so the velocity of flow though the drain cover is less than about 1.5 feet per sec flow at any point on the drain cover even if as much as 20% blocked by a swimmer to protect a swimmer from entrapment.

It is an object of the invention to provide a adapter ring for an existing swimming pool drain sump that has means to allow water to flow around it when positioned in a drain sump to allow water to flow out a pool drain pipe.

It is an object of the invention to provide a new drain cover for an existing pool that will not trap a swimmer's hair.

It is an object of the invention to provide an anti-entrapment drain cover for an existing pool with sufficient cross sectional area and flow rate so the velocity of flow though the drain cover is in the order of 1.5 feet per sec flow at any point on the drain cover even if partially blocked by a swimmer.

It is an object of the invention to provide a method and apparatus for securing a adapter ring in an existing pool drain sump so the adapter ring is in the correct position in the pool drain sump for a supporting an anti-entrapment drain cover.

It is an object of the invention to provide a method and apparatus for modifying an existing swimming pool drain so that it allows flow of water through the drain cover in the order of 1.5 feet per see flow at any point on the drain cover even if partially blocked by a swimmer.

Other objects of the invention will be apparent from the following detailed specification.

DETAILED DESCRIPTION OF THE INVENTION

Although the present invention can be used in conjunction with most types of existing suction inlets or drain sumps, it is particularly suitable for use in connection with an existing drain sump of an existing swimming pool or spa. A primary use is to retrofit the typical eight inch round main drain sumps in existence in the typical swimming pool or spa, however it can be used in new installations. It is capable of being attached firmly to the inside of an existing main drain sump. By referring to pools. Applicant means swimming and wading pools and whirlpools and spas and similar devices Accordingly, the present invention will be described hereinafter in connection with such a drain. It should be understood, however, that the following description is only meant to be illustrative of the present invention and is not meant to limit the scope of the present invention, which has applicability to other types of suction inlets, such as outlets of whirlpools and spas.

Figure 1:
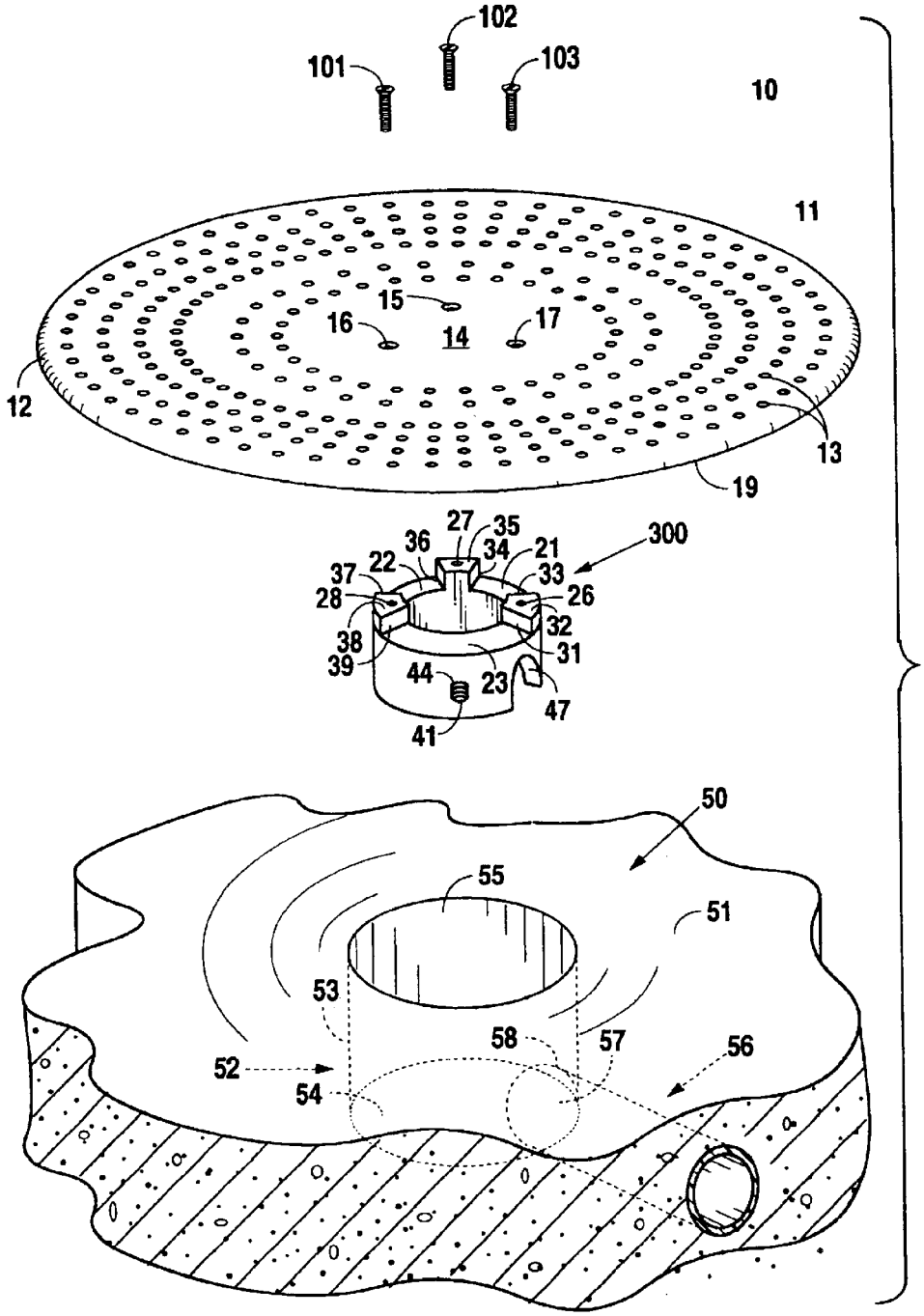
FIG. 1 is an exploded perspective view of a pool drain equipped with an embodiment of this invention including the adapter ring and the drain cover.

Referring to FIG. 1 there is shown a perspective view of an existing suction drain 50 mounted in a floor of a swimming pool 51. The drain 50 includes a generally cylindrical shaped drain sump 52 having an opening 55 formed at the top of the drain sump 52 and communicating with the swimming pool 51. The drain sump 52 also includes a side wall 53. The drain sump 52 includes an upper cylindrical edge 59 to the side wall 53 that is generally mounted flush with the bottom surface of a swimming pool at its lower most portion. The side wall 53 extends downwardly to a lower wall surface 54 that forms the drain sump 52. The drain sump 52 may also be square or other shapes. An outlet 57, that includes an outer cylindrical edge 58, is formed in the side wall 53 of the drain sump 52 and is coupled to a suction pipe 56, which is generally mounted flush with side wall 53.

In an existing pool or spa, a cover the size of the opening 55 would cover the drain sump 51. The cover on older pools or spas might be circular with a diameter the same size as the opening 55 and have a plurality of openings in the top to allow water to be pumped through line or pipe 56 but prevent large objects from getting into the sump 52. Domed covers with a diameter the same size as the opening 55 have also been used that include a plurality of openings around the periphery. Special covers with large ribs on the top have also been used. The openings in the cover have to be sufficient in cross sectional area to allow water to be pumped through drain pipe 56 and supply a conventional swimming pool pump, not shown. Conventional covers might be attached by one or more screws that were screwed into holes in the drain sump body to releasably retain the cover in place at the top of the sump and generally flush with the bottom surface of the swimming pool or spa.

It as a goal to have no more than 1.5 feet per sec (fps) flow at any point of a drain cover even if partially blocked by a swimmer. The National Spa & Pool Institute recommends that a pool or spa drain meet ASTM A-112.1908 standard to keep the velocity of flow through a drain at any point low enough to avoid entrapment.

Figure 5:
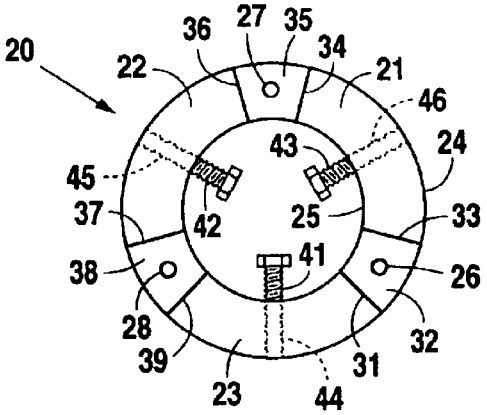
FIG. 5 is a top view of the adapter ring of FIG. 1.
Figure 6:
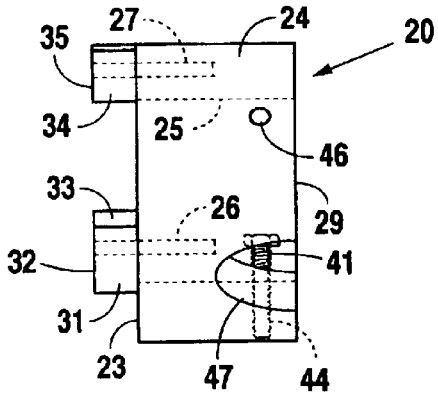
FIG. 6 is a side view of the adapter ring of FIG. 1.
Figure 7A:
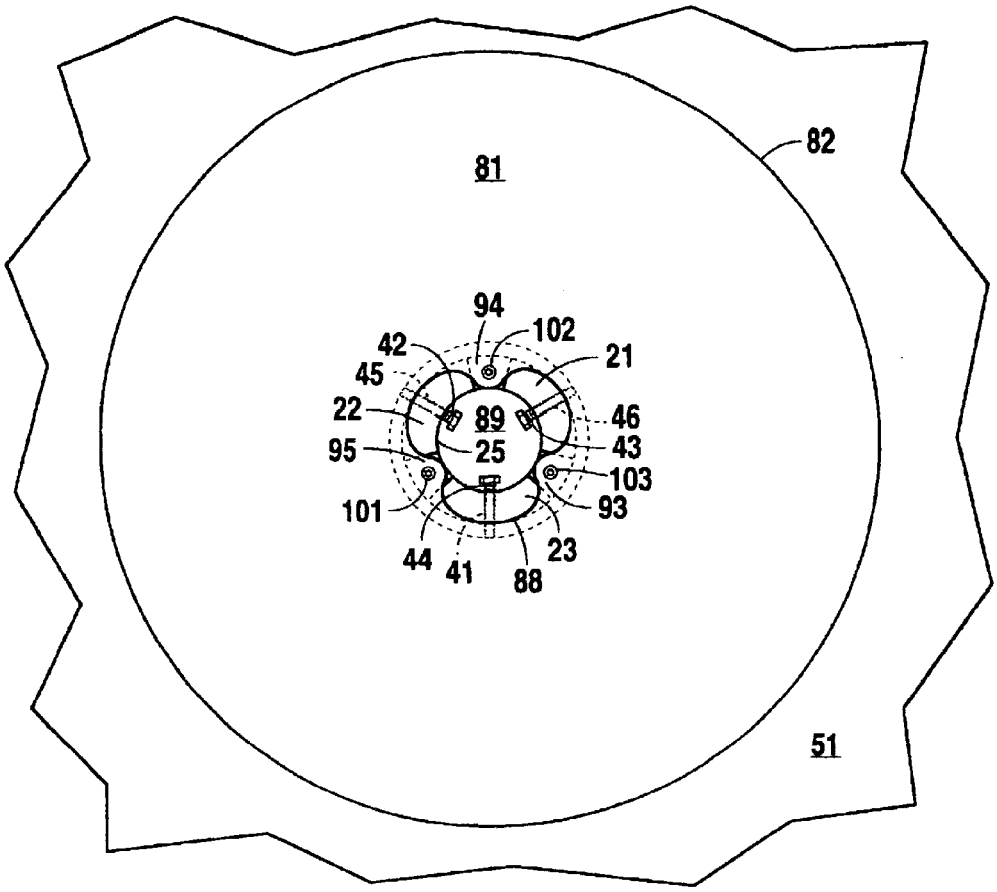
FIG. 7*a* is a top view of the installation plate attached to the adapter ring installed in a drain.
Figure 7B:
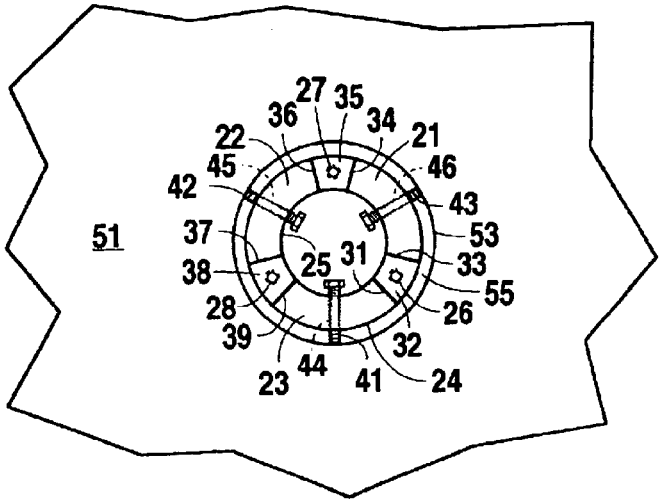
FIG. 7*b* is a top view of the adapter ring installed in a drain after the installation plate has been removed.

The invention includes a generally cylindrical adapter ring 20 having an outer cylindrical wall 24, an inner cylindrical wall 25, a lower edge surface 29 and an upper edge surface 300, which is adapted to be secured within existing drain sump 52 with three equally spaced stainless steel mounting bolts 41, 42 and 43 (only one of which is visible and shown in FIG. 1) that extend through adapter ring 20 from inner cylindrical wall 25 to outer cylindrical wall 24 through three threaded openings 44, 45 and 46, respectively, which are equidistance apart from each other around the ring peripherally and extend from the center of the ring outward, in order to allow them to be tightened to apply pressure on side wall 53 for the purpose of securing adapter ring 20 to prevent movement, as best shown by top views in FIGS. 5 and 7*b*. Once the drain cover 10 is attached, a swimmer can not access them to loosen them so the adapter ring remains firmly in place. The adapter ring is generally cylindrical in shape although other shapes that would fit within a drain sump could be used.

The adapter ring 20 includes three semicircular flat surfaces or notched out portions 21, 22 and 23 that extend around a portion of the upper surface of the adapter ring 20. Also formed at the top of the adapter ring 20 are three raised cover supports 32, 35 and 38. Perpendicular walls 31 and 33 extend up from the surfaces 21 and 23 to the support upper surface 32. Perpendicular walls 34 and 36 extend up from the surfaces 21 and 22 to the support upper surface 35. Perpendicular walls 37 and 39 extend up from the surfaces 22 and 23 to the support upper surface 38.

The three raised mounts 32, 35 and 38 engage and support a drain cover 10 and allow water to pass over the notches 21, 22 and 23 and out the drain pipe. Curved recess or notch 47 is provided in the adapter ring 20 to facilitate flow into the drain pipe when the adapter ring is lowered into the drain sump and the drain pipe is close to the adapter ring. This allows the adapter ring to be properly seated in most existing drain sumps. The curved recess on notch 47 in the underside of the adaptor ring allows clearance for the built in side suction outlet on some 8" round sumps should it be necessary to drop the adaptor ring down that far into the sump to create the desired contact and pressure on the pool floor with the cover. The adapter ring 20 is preferably sufficiently smaller than the opening in the drain sump to also allow sufficient flow to the drain pipe 56. But even if the adapter ring 20 closely fits the inner wall of the drain sump there will still be sufficient water flow over the notches 21, 22 and 23 and out the drain.

Generally industry codes call for velocity in PVC suction piping to not exceed 6 feet per second. This rate of flow was used in calculating the flow through the open areas of the adaptor or adapter ring 20. The adapter ring 20 may just barely fit into an old sump so that all the flow would have to come through these lowered areas 21, 22 and 23.

Based on the open area represented by the holes in the drain cover plus the area under the edges of the cover (less the area of the ribs), and desiring to have a flow rate not exceeding 1.5 feet per second, and a factor of safety of 1.25 it is contemplated that the holes will include at least 288 holes (or more) with a 8 mm or 0.03152 inch hole diameter, with about 75 inches of perimeter raised 3/16" to provide about 22.5 square inches for the holes and 14 square inches for the perimeter for a total of about 36.5 square inches of total flow area. At 1.5 fps this would represent about 170 GPM or about 643 liters per minute. Using a factor of safety of 1.25 this would allow this drain cover to flow at about 136 GPM or about 515 liters per minute. The number and size of the holes might also depend on the particular flow characteristics of the pool.

The ring and cover may be made of a suitable plastic material. Examples would include ABS or marine plastics such as those used on boat hulls and spas. Other durable materials that were UV inhibited could also be used.

It is primarily intended for retrofit for the typical 8" round main drains in existence. However it can be used in new installations. It is intended to attach firmly to the inside of an existing main drain sump. The attachment bolts are not available to the bather so the unit adaptor ring remains firmly in place. The cover may be held in place with 3¼" stainless steel screws 1½" long firmly screwed into threads of approximately that depth. The head of these three screws may utilize a custom recessed key head to prevent unauthorized removal. Accidents may happen with broken or missing covers.

The adaptor ring with its mounting bolts is sized to slide into most existing "8 round" main drain sumps. It is designed to allow placement into these sumps at whatever depth is required to allow the cover to be held against the pool floor with considerable pressure to prevent probing fingers to try to bend it up or break it. This pressure is achieved by placing weight on the fitting cover during installation which in turn deflects it slightly toward the drain sump thus insuring that the cover will also be deflected towards the pool floor when it is tightened down to the adaptor ring.

The drain 50 is provided with the anti-entrapment drain cover 10 adapted to be secured to the adapter ring 20 by three screws 101, 102 and 103 into three threaded bores 26, 27 and 28 in plate support surfaces 32, 35 and 38, respectively, for covering the opening 55 without substantially obstructing fluid flow through the drain sump 52, as shown in FIG. 1. The three threaded bores 26, 27 and 28 are equidistance apart, offset from the three threaded openings 44, 45 and 46, centered within plate support surfaces 32, 35 and 38 respectively, and extending downward. The three threaded bores 26, 27 and 28 extend into adapter ring 20 half the distance between plate support surfaces 32, 35 and 38 and bottom ring surface 29. The central portion of the drain cover around the three screws 101, 102 and 103 is solid so there is not flow directly above the drain sump which might increase the flow rate to too high an amount and cause entrapment.

Figure 2A:
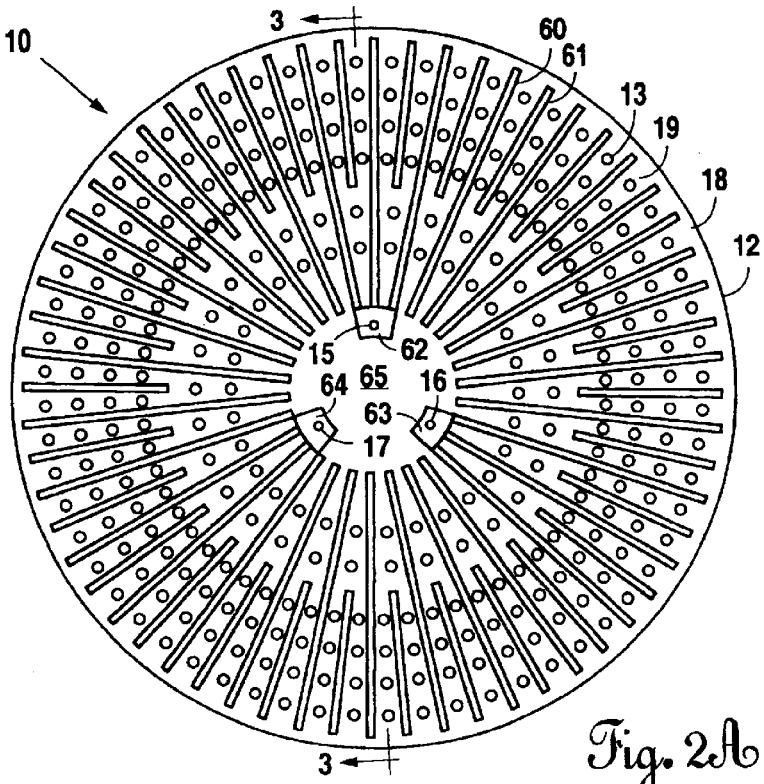
FIG. 2*a* is a bottom view of the drain cover of FIG. 1.
Figure 3:
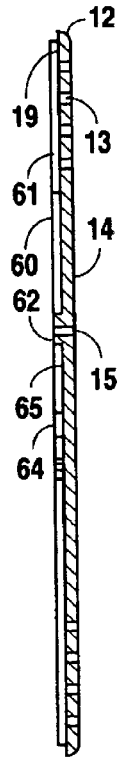
FIG. 3 is a cross section of a side view of the drain cover of FIG. 2*a*.
Figure 7C:
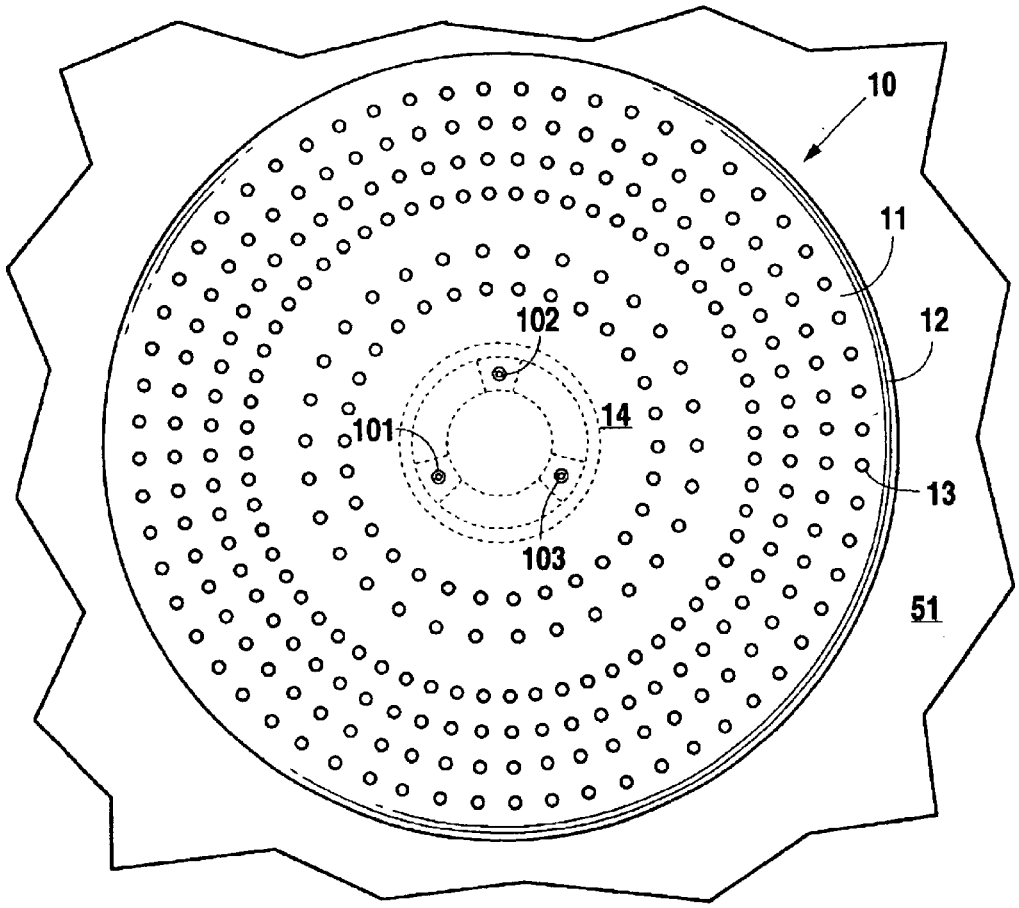
FIG. 7*c* is a top view of the drain cover attached to the adapter ring installed in a drain.
Figure 9:
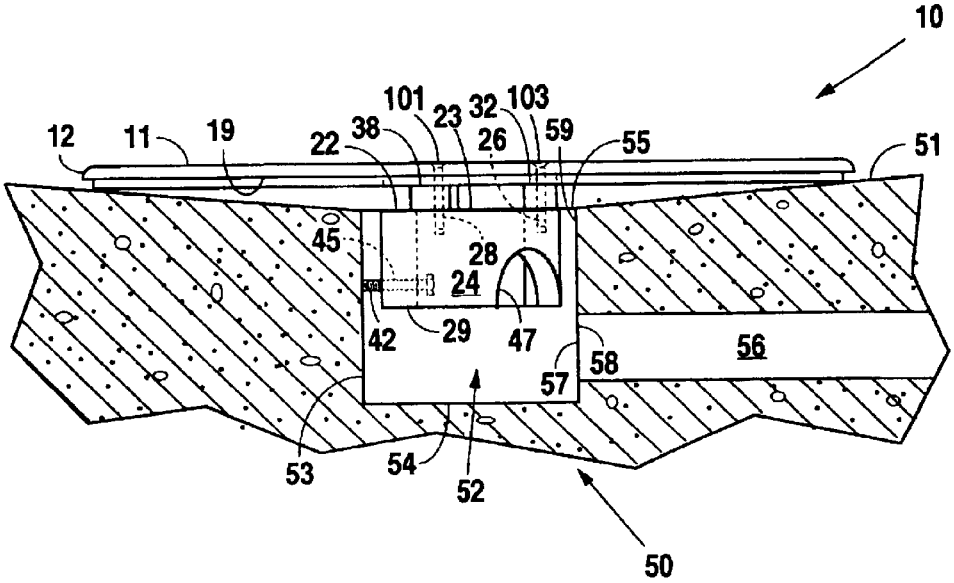
FIG. 9 is a side view of a final embodiment of the invention from FIG. 1.

Referring to FIGS. 1 and 7*c* there are respectively shown a perspective view and a top view of plastic or molded drain cover 10 which is round or disc shaped and having an upper planar surface 11 extending to beveled edge 12 (as shown in FIGS. 1, 3 and 9), which in turn, joins to a lower planar surface 19 viewed in FIG. 2*a*. As shown in FIGS. 1 and 2*a*, the planar, generally flat surfaces 11 and 19 are perforated by a plurality of small circular holes 13, in a radial pattern, designed to permit substantial downward water flow through the drain cover 10, at a low velocity to avoid entrapment. The holes 13 extend through the upper and lower surfaces 11 and 19 excluding non-vented surfaces 14 and 65. As many as about 288 holes are provided in the drain cover so that the flow through the drain cover is at a rate that will not entrap a swimmer the diameter of the holes may be in the order of 8 mm in diameter to allow sufficient water flow.

Three spacers 62, 63 and 64 are secured to the lower surface 65 of the drain cover 10 so that its lower surface will fit flush with the top of the three raised cover supports 32, 35 and 38 and maintain the drain cover at a proper spacing from the adapter ring. The spacers 62, 63 and 64 are the same thickness as the ribs or spacers 60 and 61 so that the lower surface of the drain cover is at the same position as the installation plate 80. Accordingly the spacers 62, 63 and 64 are equidistance from each other have the same relative surface size and shape as plate supports 32, 35 and 38 so that when the adapter ring is secured in place with the installation plate, the drain cover will fit correctly and engage the bottom of a pool. The lower surface of the installation plate is flat and the lower surface of the drain cover 10 must end up at the same level when installed. Instead of three spacer surfaces a ring the same width and thickness of the three spacers 62, 63 and 64 is attached to or formed with the lower surface of the drain cover. However, if a ring was used it should be spaced from the pool bottom when installed so as to not impede flow.

Non-perforated central surface portions 14 and 65 are generally circular in shape and are at the center of surfaces 11 and 19 extending out to a distance beyond the dimensions of the drain opening 55, best shown in FIG. 1. The non-perforated surfaces 14 and 65 and spacer surfaces 62, 63 and 64 include three holes 15, 16 and 17 respectively through which three screws 101, 102 and 103, as shown in FIG. 1, can be screwed into holes 26, 27 and 28 to secure the drain cover 10 to adapter ring 20, best shown in FIG. 9. FIG. 2*a* shows a large plurality of raised ribs, represented by ribs 60 and 61, extending out radially on planar surface 19.

The large plurality of raised ribs or spacers, represented by ridge 60, extend radially outward from non-vented surface portion 65 to the edge of planar surface 19. The large plurality of raised ribs, represented by ridge 61, extend radially outward from half the distance to the non-vented surface 65 to the edge of planar surface 19. The large plurality of raised ribs, represented by ribs 60 and 61, are designed to rest on and contact the floor of the swimming pool 51, to permit fluid to flow between the ribs, and under drain cover 10 into the drain 50. Water can flow under the edge of the drain cover and between the ribs even with the holes 13 are blocked. Alternatively, another embodiment would utilize rows of very small raised semi spherical spacers extending out radially, instead of raised ribs. The ribs 60 and 61 and space surfaces 62, 63 and 64 may be in the order of 3/16" inches high. The ribs 60 and 61 should be high enough to allow sufficient water flow and still prevent small fingers from being inserted under them.

Figure 2B:
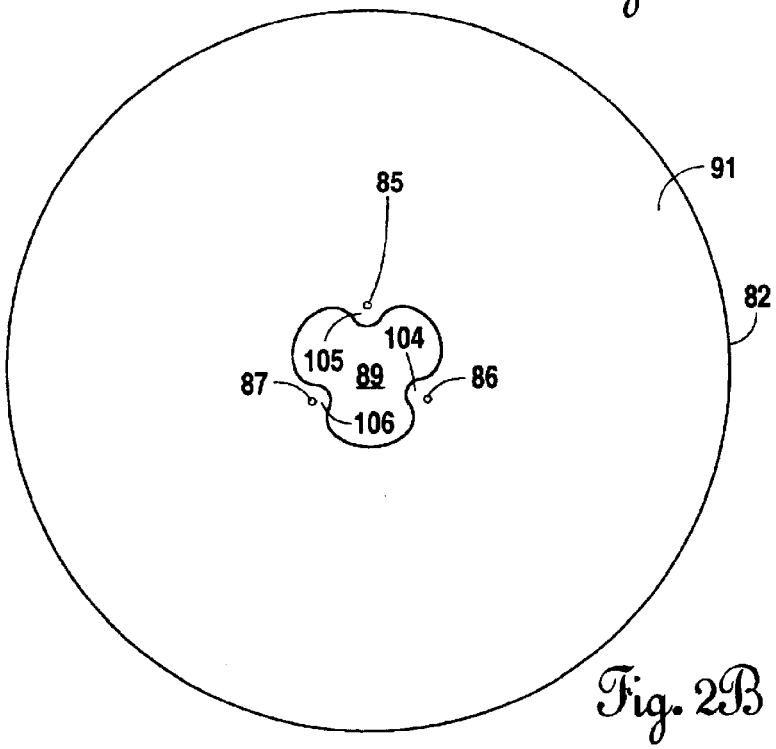
FIG. 2*b* is a bottom view of the installation plate.
Figure 4:
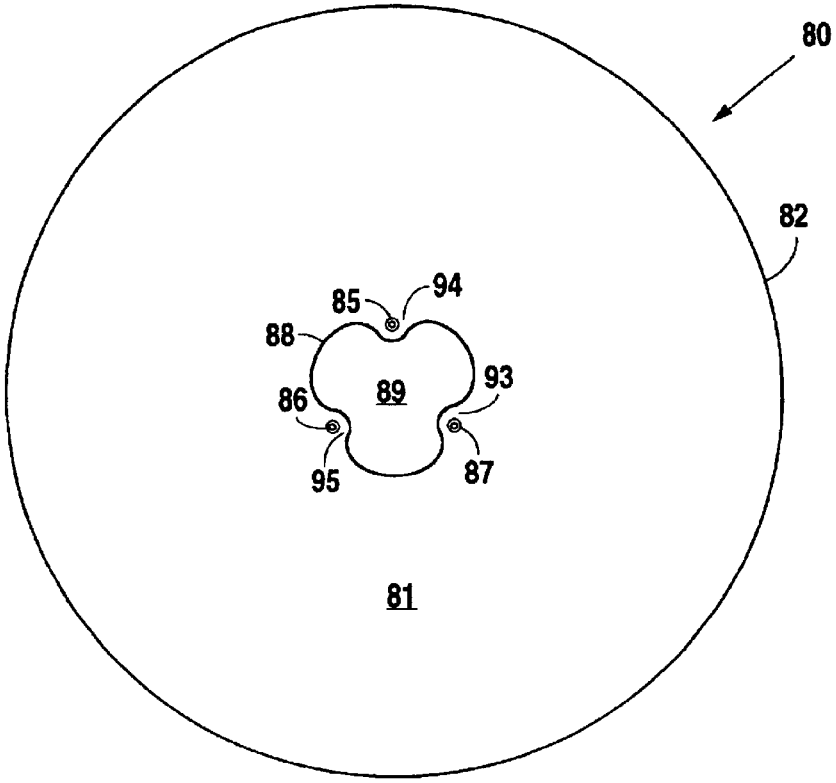
FIG. 4 is a top view of the installation plate.
Figure 8:
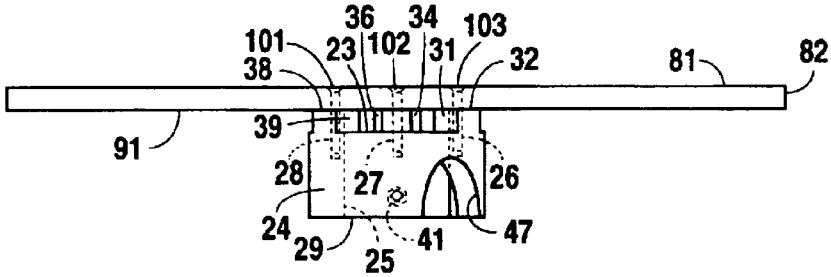
FIG. 8 is a side view of the installation plate attached to the adapter ring.

Referring to FIGS. 4 and 7*a* there is shown the installation plate 80 designed to facilitate the installation of adapter ring 20 into the suction drain 50. FIGS. 4 and 7*a* show a top view of installation plate 80 which is disc shaped with an upper planar surface 81, extending to vertical edge 82 (as shown in FIGS. 2*b* and 8), which in turn, extends to a lower planar surface 91, viewed in FIG. 8. The installation plate 80 has the same overall diameter and size as the drain cover 10 so that the adapter ring 20 will be properly positioned during installation so that the drain cover will fit correctly.

Upper planar surface 81 and lower planar surface 91 has a three-lobed central opening 89, defined by three attaching portions 93, 94 and 95 on the upper planar surface 81 and three mounting surfaces 104, 105 and 106 on the lower planar surface 91, as shown in FIGS. 2*b*, 4 and 7*a* for releasably attaching the installation plate 80 to the adaptor ring 20. The three-lobed opening 89 is designed to allow access to the three mounting bolts 41, 42 and 43 which secure the adapter ring 20 to the drain body 52, while the installation plate 80 is attached to adapter ring 20 during installation, best shown in FIG. 7*a* with three screws 101, 102 and 103. The three screws 101,102 and 103 permit the installation ring 80 to be releasably secured to the adaptor ring.

FIGS. 4 and 7*a* show that integral attaching portions 93, 94 and 95 are equidistance from each other and are continuous with the surface 81. The attaching portions 93, 94 and 95 are arced and extend inward towards the center of installation plate 80 forming an inner edge 88, ultimately defining the three-lobed opening 89. FIG. 2*b* shows that three mounting surfaces 104, 105 and 106 are equidistance from each other and are integral with the surface portion 91. The three mounting surfaces 104, 105 and 106 are arced and extend inward towards the center of installation plate 80, mirroring attaching portions 93, 94 and 95, forming inner edge 88, ultimately defining the three-lobed opening 89. The purpose of installation plate 80 is to simulate the position of drain cover 10 in the final embodiment of the invention.

The installation plate 80 is identical in general shape and size to the drain cover 10 so that when the adapter ring 20 is installed, either can be attached to the adapter ring.

The installation of the drain cover 10 and adapter ring 20 is as follows. Any existing drain cover is removed from the sump 52 leaving an opening at the upper portion adjacent the bottom of the pool. The adapter ring 20 is then attached to the installation plate 80 with the three screws 101, 102 and 103, see FIG. 8. The next step is to position the adapter ring 20 inside the sump 52 with the installation plate 80 flush with the bottom of the pool, see FIG. 7*a*. Sufficient downward pressure is applied to the installation plate 80 to insure that it is flush with the bottom of the pool at its periphery so that there is no space for fingers to be inserted under the edge, see FIG. 9. With the installation plate 80 firmly in place, the three bolts 41, 42 and 43 are then screwed in so that the ends of the bolts engage the inner wall of the 55 of the sump 52, see FIG. 7*b*.

It is desirable to screw in the three bolts 41, 42 and 43 about the same amount so as to approximately center the adapter ring 20 inside the sump 52 as shown in FIG. 7*b*. This is possible because of the opening 89 which allow access to the bolts 41, 42 and 43, see FIG. 7*a*. Although three bolts are shown, additional mounting bolts could be provided to securely mount the adapter ring 20 inside the sump 52. For instance if four equally spaced mounting bolts were provided then four equally spaced lobes or cutouts would be needed in the installation plate 80 to allow access to the bolts. After the three bolts 41, 42 and 43 are sufficiently tightened to securely engage the inner wall of the sump 52, the installation plate can be removed by unscrewing the three screws 101, 102 and 103.

After the installation plate is removed, the adapter ring 20 is left secured in place inside the sump 52 and is securely attached to the sump 52 by the bolts 41, 42 and 42, see FIG. 7*b*. The next step is to place the drain cover 10 by positioning it over the adapter ring 20 and attaching thereto with the three screws 101, 102 and 103, see FIG. 7*c*. Because the drain cover 10 is the same general size and shape as the installation 80, the drain cover is attached flush with the bottom of the pool and acts as a replacement for the original much smaller drain cover.

Figure 10:
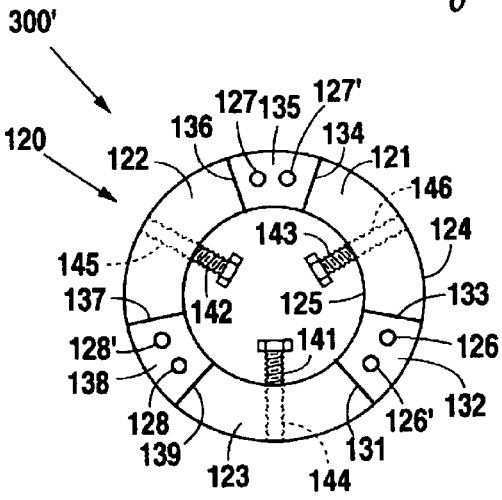
FIG. 10 is an alternative embodiment of the adapter ring.

Another embodiment of the adapter ring is show in FIG. 10. The invention includes a generally cylindrical adapter ring 120 having an outer cylindrical wall 124, an inner cylindrical wall 125, a lower edge surface 29 and an upper edge surface 300', which is adapted to be secured within existing drain sump 52 with three equally spaced stainless steel mounting bolts 141, 142 and 143 that extend through adapter ring 120 from inner cylindrical wall 125 to outer cylindrical wall 124 through three threaded openings 144, 145 and 146, respectively, which are equidistance apart from each other around the ring peripherally and extend from the center of the ring outward, in order to allow them to be tightened to apply pressure on side wall 53 for the purpose of securing adapter ring 120 to prevent movement, in a similar manner as shown for adapter ring 20 in top views in FIGS. 5 and 7*b*. Once the drain cap or cover is attached, a swimmer can not access them to loosen them so the adapter ring remains firmly in place.

The adapter ring 120 includes three semicircular flat surfaces or notched out portions 121, 122 and 123 that extend around a portion of the upper surface of the adapter ring 120. Also formed at the top of the adapter ring 20 are three raised cover supports 132, 135 and 138.

The three raised mounts 132, 135 and 138 engage and support a drain cap or cover and allow water to pass over the notches 121, 122 and 123 and out the drain pipe. A curved recess or notch exactly like the curved recess or notch 47 is provided in the adapter ring 120 to facilitate flow into the drain pipe when the adapter ring is lowered into the drain sump and the drain pipe is close to the adapter ring. This allows the adapter ring to be properly seated in most existing drain sumps. The curved recess on notch in the underside of the adaptor ring allows clearance for the built in side suction outlet on some 8" round sumps should it be necessary to drop the adaptor ring down that far into the sump to create the desired contact and pressure on the pool floor with the cover. The adapter ring 120 is preferably sufficiently smaller than the opening in the drain sump to also allow sufficient flow to the drain pipe 56. But even if the adapter ring 120 closely fits the inner wall of the drain sump there will still be sufficient water flow over the notches 121, 122 and 123 and out the drain.

Figure 11:
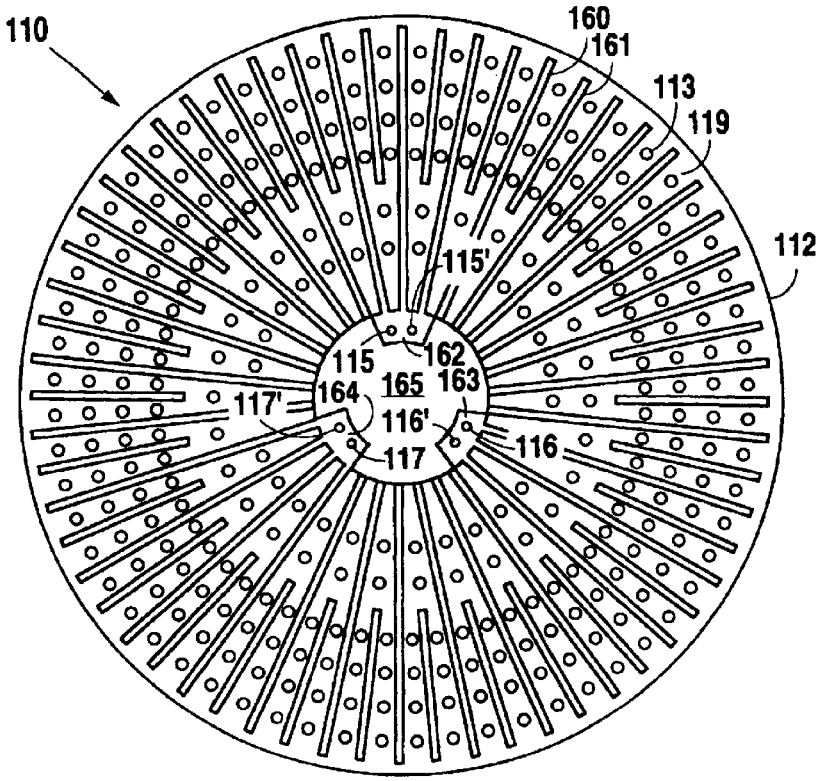
FIG. 11 is an alternative embodiment of the drain cover.

Referring to FIG. 11 there is shown a bottom view of an alternative plastic or molded drain cover which includes a drain cap or cover 110 which is round or disc shaped and having an upper planar surface extending to beveled edge exactly as the beveled edge 12 of the first embodiment (as shown in FIGS. 1, 3 and 9), which in turn, joins to a lower planar surface 119 viewed in FIG. 11. As shown in FIG. 11, the planar, generally flat drain cover is perforated by a plurality of small circular holes 113, in a radial pattern, designed to permit substantial downward water flow through the drain cover 10, at a low velocity to avoid entrapment. The holes 113 extend through the drain cover. As many as about 288 holes are provided in the drain cover so that the flow through the drain cover is at a rate that will not entrap a swimmer the diameter of the holes may be in the order of 8 mm in diameter to allow sufficient water flow.

An opening 165 is formed at the center of the drain cover to allow access to the three bolts 141, 142 and 143 to allow access to them for tightening and installing the adapter ring. Three mounting tabs 162, 163 and 164 are formed with the drain cover at the periphery of the opening 165 for securing the drain cover with the top of the three raised cover supports 132, 135 and 138 and maintain the drain cover. The mounting tabs 162, 163 and 164 are equidistance from each other have the same relative surface size and shape as plate supports 132, 135 and 138 so that when the adapter ring is secured in place with the installation plate, the drain cover will fit correctly and engage the bottom of a pool. The tabs 162, 163 and 164 include two holes each, 115, 116 and 117 respectively through which three screws like screws 101, 102 and 103, in a manner as shown in FIG. 1, can be screwed into holes 126, 127 and 128 to secure the drain cap or cover to adapter ring 120. FIG. 11 shows a large plurality of raised ribs, represented by ribs 160 and 161, extending out radially on planar surface 119.

The large plurality of raised ribs or spacers, represented by ridge 160, extend radially outward from opening 165 to the edge of planar surface 19. The large plurality of raised ribs, represented by ridge 161, extend radially outward from half the distance to the opening 165 to the edge of planar surface 119. The large plurality of raised ribs, represented by ribs 160 and 161, are designed to rest on and contact the floor of the swimming pool 51, to permit fluid to flow between the ribs, and under drain cap or cover into the drain 50. Water can flow under the edge of the drain cover and between the ribs even with the holes are blocked. Alternatively, another embodiment would utilize rows of very small raised semi spherical spacers extending out radially, instead of raised ribs. The ribs 160 and 161 may be in the order of 3/16" inches high. The ribs 160 and 161 should be high enough to allow sufficient water flow and still prevent small fingers from being inserted under them.

Figure 12:
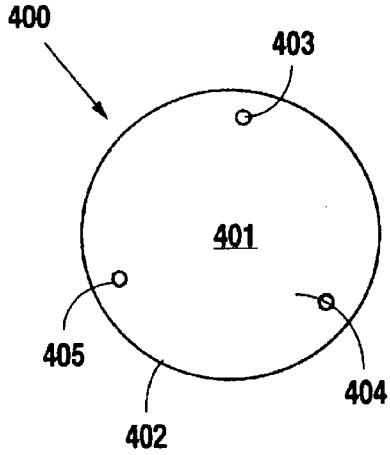
FIG. 12 is a center cover for the drain cover shown in FIG. 11.

As will be apparent, the embodiment shown in FIG. 11 does not require a separate installation plate because the opening 165 gives access to the bolts in the adapter ring. However a circular cover 170 is required for the opening 165. The embodiment of FIG. 11 would be installed exactly like the embodiment of FIG. 1 except that the adapter ring would be secured in the drain sump with the drain cap or cover in place and also functioning as an installation plate. After securing the adapter ring 120 in position, the circular cover 400, which is part of the drain cap or cover would be secured to the adapter ring 120 through drain cover 110 into holes 126', 127' and 128' of adapter ring 120 with three additional stainless steel screws like screws 101, 102 and 103. Referring to FIG. 12 there is shown a top view of an alternative plastic or molded circular cover 400 which is round or disc shaped and having an upper planar surface 401 extending to vertical edge 402 and having three equidistance spaced screw holes 403, 404 and 405 for alignment with holes 126', 127' and 128' in adapter ring 120. Or the cover 400 could be attached to the drain cap or cover by other conventional means including a twist lock or the like.

The device of the invention takes into consideration a typically sized person so that entrapment can be avoided. There may be persons that are big enough to block the entire drain cover but these people are not as likely to be at risk. Also even if the top of the drain cover is blocked there is still flow around the edges. Hair entrapment is also a very big concern. Some conventional drains that would otherwise past tests such as an ASME test would not pass a hair test in that long hair could be sucked into the drain cover and entrap a swimmer at the drain. In simulated tests, the device of the invention would not trap long hair in the drain at standard flow rates of 1.5 fps. Available 8 inch drain covers that were tried in the tests did trap long hair. Based on calculations, the invention should not be capable of entrapping an average size person or child's hair or body or entrapping or disemboweling a person who sits on the drain cover.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for mounting a safety drain cover apparatus in a swimming pool drain to protect a swimmer from entrapment of the swimmer's body or hair, comprising:

positioning an installation plate that is releasably secured onto a drain sump adapter ring in engagement with the bottom of a pool for positioning and aligning the adapter ring in a pool drain sump with the installation plate for securing the drain sump adapter ring;

securing the adapter ring into a pool drain sump so the adapter ring is in the correct position in the pool drain sump for a supporting an anti-entrapment drain cover;

attaching an anti-entrapment drain cover to the adapter ring in place of the installation plate and in engagement with the bottom of a pool and said drain cover allowing flowing water past said drain cover at a velocity of flow so that even if the drain cover is partially blocked by a swimmer the flow rate will protect a swimmer from entrapment of the swimmer's body or hair.

2. The method of claim 1, including the step of:

tightening a plurality of bolts in the adapter ring so that the bolts engage the drain sump and secure the adapter ring in position.

3. The method of claim 1, including the step of:

flowing water through the drain cover in the order of 1.5 feet per sec flow at any point on the drain cover even if partially blocked by a swimmer to protect a swimmer from entrapment of the swimmer's body or hair.

4. The method of claim 1, including the step of:

flowing water over the adapter ring when it is secured in the drain sump and out a drain pipe.

5. A method for mounting a replacement safety drain cover apparatus in a swimming pool drain to protect a swimmer from entrapment of the swimmer's body or hair, comprising:

positioning and aligning a generally cylindrical drain sump adapter ring having a first size in a pool drain sump;

securing the adapter ring into a pool drain sump so the adapter ring is in the correct position in the pool drain sump to support an anti-entrapment drain cover;

covering the drain sump and adapter ring with a replacement anti-entrapment drain cover in engagement with the bottom of a pool and having a size substantially greater than the adapter ring and said drain cover allowing flowing water past and under said drain cover at a velocity of flow so that even if the drain cover is partially blocked by a swimmer the flow rate will protect a swimmer from entrapment of the swimmer's body or hair;

positioning an installation plate that is releasably secured onto the drain sump adapter ring in engagement with the bottom of a pool for positioning and aligning the adapter ring in a pool drain sump with the installation plate for securing the drain sump adapter ring; and securing the adapter ring into a pool drain sump so the adapter ring is in the correct position in the pool drain sump for a supporting an anti-entrapment drain cover and removing the installation plate.

6. The method of claim 5, including the step of:

tightening a plurality of bolts in the adapter ring so that the bolts engage the drain sump and secure the adapter ring in position.

7. The method of claim 5, including the step of:

flowing water through the drain cover in the order of 1.5 feet per sec flow at any point on the drain cover even if partially blocked by a swimmer to protect a swimmer from entrapment of the swimmer's body or hair.

8. The method of claim 5, including the step of:

flowing water over the adapter ring when it is secured in the drain sump and out a drain pipe.

9. A replacement safety drain cover apparatus for a pool drain to protect a swimmer from entrapment, comprising:

a generally cylindrical drain sump adapter ring having a first size for mounting and securing in a pool drain sump;

securing means to secure the adapter ring into the pool drain sump;

an anti-entrapment drain cover having a size substantially greater than the generally cylindrical drain sump adapter ring and for securing to the adapter ring and engaging the bottom of a pool to cover the drain sump;

said anti-entrapment drain cover having a plurality of openings there through with sufficient cross sectional area so that the velocity of flow though the openings and at the periphery and under the drain cover and at any point on the drain cover even if partially blocked by a swimmer is at a rate to protect a swimmer from entrapment of the swimmer's body or hair; and an installation plate is provided for releasably securing onto the adapter ring and for engaging the bottom of a pool for positioning and aligning the adapter ring in a pool drain sump for securing the securing means and adapter ring in the correct position in the pool drain sump for a drain cover.

10. The apparatus of claim 9, wherein:

the installation plate has a size and shape to position the adapter ring at the correct position in a pool sump for mounting of the drain cover.

11. The apparatus of claim 9, wherein:

the installation plate has an access opening to allow access to the securing means to allow securing of the adapter ring at the correct position in a pool sump for mounting of the drain cover.

12. The apparatus of claim 9, wherein:

the drain cover has spacer means on its lower surface to allow flow of water at the edge and under the drain cover to a pool drain sump if the cover is partially blocked by a swimmer to protect a swimmer from entrapment of the swimmer's body or hair.

13. The apparatus of claim 9, wherein:

the installation plate is approximately the same size and shape as the drain cover.

14. A replacement safety drain cover apparatus for a pool drain to protect a swimmer from entrapment, comprising:

a generally cylindrical drain sump adapter ring having a first size for mounting and securing in a pool drain sump;

securing means to secure the adapter ring into the pool drain sump;

an anti-entrapment drain cover having a size substantially greater than the generally cylindrical drain sump adapter ring and for securing to the adapter ring and engaging the bottom of a pool to cover the drain sump;

said anti-entrapment drain cover having a plurality of openings there through with sufficient cross sectional area so that the velocity of flow though the openings and at the periphery and under the drain cover and at any point on the drain cover even if partially blocked by a swimmer is at a rate to protect a swimmer from entrapment of the swimmer's body or hair; and the drain cover has an opening in the center for allowing access to the securing means; and a cover for closing off the opening in the center of the drain cover.

15. The apparatus of claim 14, wherein:

the anti-entrapment drain cover has sufficient cross sectional area and flow rate so the velocity of flow though the drain cover is in the order of 1.5 feet per sec flow at any point on the drain cover even if partially blocked by a swimmer to protect a swimmer from entrapment of the swimmer's body or hair.

16. The apparatus of claim 14, wherein:

the anti-entrapment drain cover has a diameter of about 24 inches to protect a swimmer from entrapment of the swimmer's body or hair.

17. The apparatus of claim 14, wherein:

the adapter ring has means to allow water to flow around it when positioned in a drain sump to allow water to flow out a pool drain pipe.

18. The apparatus of claim 14, wherein:

the anti-entrapment drain cover having spacers on its lower surface to allow flow around the periphery and under the drain cover to prevent the flow of water through the drain cover from exceeding a velocity of flow to protect a swimmer from entrapment of the swimmer's body or hair.

19. The apparatus of claim 14, wherein:

the adapter ring has raised cover supports to allow flow of water over the adapter ring when positioned in a drain sump to allow water to flow out a pool drain pipe.

20. The apparatus of claim 14, wherein:

the anti-entrapment drain cover having sufficient openings in the top and around the edge to prevent the flow of water through the drain cover from exceeding a velocity of flow to protect a swimmer from entrapment of the swimmer's body or hair.

21. A replacement safety drain cover apparatus for a pool drain to protect a swimmer from entrapment, comprising:

a generally cylindrical drain sump adapter ring having a first size for mounting and securing in a pool drain sump;

securing means to secure the adapter ring into the pool drain sump;

an anti-entrapment drain cover having a size substantially greater than the generally cylindrical drain sump adapter ring and for securing to the adapter ring and engaging the bottom of a pool to cover the drain sump;

said anti-entrapment drain cover having a plurality of openings there through with sufficient cross sectional area so that the velocity of flow though the openings and at the periphery and under the drain cover and at any point on the drain cover even if partially blocked by a swimmer is at a rate to protect a swimmer from entrapment of the swimmer's body or hair;

the drain cover has an opening in the center for allowing access to the securing means;

a cover for closing off the opening in the center of the drain cover;

the drain cover has spacer means on its lower surface to allow flow of water at the edge and under the drain cover to a pool drain sump;

the anti-entrapment drain cover has sufficient cross sectional area and flow rate so the velocity of flow though the drain cover is in the order of 1.5 feet per see flow at any point on the drain cover even if partially blocked by a swimmer to protect a swimmer from entrapment of the swimmer's body or hair; and the adapter ring has means to allow water to flow around it when positioned in a drain sump to allow water to flow out a pool drain pipe.

22. A safety drain cover apparatus for a swimming pool drain to protect a swimmer from entrapment, comprising:

a drain sump adapter ring having a first size for mounting in a pool drain sump;

a securing means to secure the adapter ring into the pool drain sump;

an installation plate for releasably securing onto the adapter ring and for engaging the bottom of a pool for positioning and aligning the adapter ring in a pool drain sump for securing the adapter ring in the correct position in the pool drain sump for a drain cover; and an anti-entrapment drain cover having a size substantially greater than the drain sump adapter and for securing to the adapter ring and engaging the bottom of a pool and having sufficient cross sectional area and flow rate so the velocity of flow though the drain cover is in the order of 1.5 feet per sec flow at any point on the drain cover even if partially blocked by a swimmer to protect a swimmer from entrapment of the swimmer's body or hair;

the installation plate having a size and shape to position the adapter ring at the correct position in a pool sump for mounting of the drain cover;

the drain cover having spacer means on its lower surface to position the mounting to allow flow of water at the edge and under the drain cover and into a pool drain sump;

the installation plate having an access opening to allow access to the securing means to allow securing of the adapter ring at the correct position in a pool sump for mounting of the drain cover; and the installation plate is approximately the same size as the drain cover.

23. A replacement safety drain cover apparatus for a pool drain to protect a swimmer from entrapment, comprising:

a generally cylindrical drain sump adapter ring having a first size for mounting and securing in a pool drain sump;

securing means to secure the adapter ring into the pool drain sump;

an anti-entrapment drain cover having a size substantially greater than the generally cylindrical drain sump adapter ring and for securing to the adapter ring and engaging the bottom of a pool to cover the drain sump;

said anti-entrapment drain cover having a plurality of openings there through with sufficient cross sectional area so that the velocity of flow though the openings and at the periphery and under the drain cover and at any point on the drain cover even if partially blocked by a swimmer is at a rate to protect a swimmer from entrapment of the swimmer's body or hair;

the drain cover has an opening in the center for allowing access to the securing means;

a drain cover for closing off the opening in the center of the drain cover;

the drain cover has spacer means on its lower surface to allow flow of water at the edge and under the drain cover to a pool drain sump if the cover is partially blocked if partially blocked by a swimmer to protect a swimmer from entrapment of the swimmer's body or hair;

the anti-entrapment drain cover has sufficient cross sectional area and flow rate so the velocity of flow though the drain cover is in the order of 1.5 feet per sec flow at any point on the drain cover even if partially blocked by a swimmer to protect a swimmer from entrapment of the swimmer's body or hair;

the anti-entrapment drain cover has a diameter of about 24 inches to protect a swimmer from entrapment of the swimmer's body or hair;

the anti-entrapment drain cover having spacers on its lower surface to allow flow around the periphery and under the drain cover to prevent the flow of water through the drain cover from exceeding a velocity of flow to protect a swimmer from entrapment of the swimmer's body or hair;

the adapter ring has raised cover supports to allow flow of water over the adapter ring when positioned in a drain sump to allow water to flow out a pool drain pipe; and the anti-entrapment drain cover having sufficient openings in the top and around the edge to prevent the flow of water through the drain cover from exceeding a velocity of flow to protect a swimmer from entrapment of the swimmer's body or hair.

* * * * *